United States Patent [19]

Tobin

[11] 4,349,803

[45] Sep. 14, 1982

[54] FUSE TUBE

[75] Inventor: Thomas J. Tobin, Northbrook, Ill.

[73] Assignee: S&C Electric Company, Chicago, Ill.

[21] Appl. No.: 260,451

[22] Filed: May 4, 1981

[51] Int. Cl.[3] ..... H01H 85/20

[52] U.S. Cl. ..... 337/186; 337/201; 337/247

[58] Field of Search ..... 337/186, 201, 228, 246, 337/247

[56] References Cited

U.S. PATENT DOCUMENTS 3,983,525 9/1976 Healey ..... 337/186

3,986,157 10/1976 Salzer et al. ..... 337/186

*Primary Examiner*—George Harris

*Attorney, Agent, or Firm*—John D. Kaufmann

[57] ABSTRACT

A pressure- and weather-resistant fuse tube having fiberglass reinforcement which cannot interfere with arc-extinguishment and which does not require an insert or liner of arc-extinguishing material. The fuse tube is molded from a thermosetting material which includes an effective amount of an arc-extinguishing material. The fuse tube includes an inner bore-defining portion and an outer weather-resistant portion which are simultaneously molded along an interface at which is located a layer of porous fiberglass cloth, or filament. The fiberglass is sufficiently porous to permit the material of both portions to pass through and thoroughly impregnate it, thereby locking both portions to each other and to the fiberglass which is located well away from the bore thereof.

7 Claims, 2 Drawing Figures

FUSE TUBE

BACKGROUND OF THE INVENTION

1. Field of the Invention

The present invention relates to an improved fuse tube for a fuse, and more specifically, to an integrally molded fuse tube for a fuse or fuse cutout which is convenient to manufacture and which exhibits high burst strength along with good arc-extinguishing properties. The present invention constitutes an alternative to the invention described and claimed in commonly-assigned, co-pending United States Patent Application, Ser. No. 73,667, filed Sept. 10, 1979 in the name of Tobin, and an improvement over the following U.S. Pat. Nos. 4,104,604, issued Aug. 1, 1978 to George; 3,983,525, issued Sept. 28, 1976 to Healey; 3,922,385, issued Oct. 7, 1975 to Blewitt, Cameron and Vondracek; 3,846,727, issued Nov. 5, 1974 to Harmon; 3,120,594, issued Feb. 4, 1964 to Russel; 3,111,567, issued Nov. 19, 1963 to Stewart and Bulloch; 2,929,900, issued Mar. 22, 1960 to White; and 2,826,660, issued Mar. 11, 1958 to Kozacka.

2. Prior Art

Fuse tubes for use in fuses, fuse cutouts or similar devices are well-known. Typically, as exemplified by the Russel, Stewart and White patents, above, such fuse tubes include an outer, mechanically strong and weather resistant tube within which is located an inner sleeve made of, or containing, an ablative arc-extinguishing material such as horn fiber, melamine or the like. The outer tube and the inner sleeve are typically formed of different materials and the sleeve defines an internal bore. In typical use, conductive end fittings are mounted to the fuse tube, which is placed in a mounting. A fuse link, which includes a fusible element mounted between a stationary and a movable terminal, is located within the bore of the sleeve and the ends of the fuse link are connected to opposed points of a circuit via the end fittings. The fuse or fuse cutout operates when, upon the melting or fusing of the fusible element due to an overcurrent in the circuit, an arc is established between the terminals within the bore of the sleeve. The arc is elongated by movement of the movable contact, and the elongating arc interacts with the sleeve to rapidly evolve large quantities of deionizing, cooling and turbulent arc-extinguishing gas. Arc elongation and the action of the gas ultimately extinguish the arc and interrupt current in the circuit.

The outer tube must be mechanically strong and weather resistant for several reasons. Since fuses and fuse cutouts may reside in outdoor environments for substantial periods of time, the outer tube must be able to resist the effects thereof, including the effects of thermal cycling, rain, wind, pollution, and sunlight. Additionally, the outer tube must be mechanically strong, both to protect the fuse link and to resist bursting during operation of the fuse or cutout, during which the arc-extinguishing gases are generated. In order to ensure effective extinguishment of the arc, the fuse tube must remain integral and not burst; should the fuse tube burst, the arc may not be extinguished to the detriment of the circuit the fuse or cutout is designed to protect, as well as to the possible detriment of surrounding structures which may be damaged by a prsistent arc.

The responses of the prior art to these requirements for a fuse tube have been similar. The Russell, Stewart, and White patents, noted above, disclosed fuse tubes wherein the bore wall of the inner sleeve of the fuse participates in arc extinguishment, as discussed earlier. The fuse tube includes an ouer tube which has high burst strength and includes a thermosetting resin in which fibrous material may be included to that end. The strong outer tube is lined with the separate inner sleeve formed of, or containing, an arc-extinguishing material. The inner sleeve is inserted into the outer tube and the two are bonded together in a variety of ways. Tests of these and similar prior art fuse tubes have indicated that the effects of outdoor environments, including the effects of thermal cycling, often cause delamination or separation between the outer tube and the inner sleeve. This delamination or separation is undesirable inasmuch as both the strength characteristics of the fuse tube may be compromised and the bore of the sleeve which houses the fuse link may assume an irregular configuration which can deleteriously effect the ability of the fuse tube to effect arc extinguishment. As shown in Russell, the arc-extinguishing material inner sleeve may be rather thin. Accordingly, following a number of operations of the fuse cutout in which the fuse tube is included, the sleeve may ultimately be completely eroded in places, leaving thereat only the non-arc-extinguishing material of the outer tube exposed to subsequent arcs.

Numerous other patents exemplified by the George, Healey, Harmon, Kozacka, and Blewitt patents show fuse housings of a type specifically adapted for use in current-limiting fuse. Housings of the latter patents are made of thermosetting or similar polymeric materials which contain therein strengthening materials, such as fiberglass mat or cloth or woven or wound fiberglass strands, to improve the burst strength thereof. These housings are, however, not suitable for use as the fuse tube of non-current-limiting fuses or fuse cutouts. Specifically, all of these patents show a fuse housing having an internal cavity, the fiberglass or other strengthening material being incorporated throughout the entire or most of the thickness of the housing. Typically, the housing does not participate in arc-extinguishment. Should such a housing be used in a fuse cutout, even if the interior of the walls of the housing have arc-extinguishing properties, which they do not, after only a very few uses of the fuse tube, sufficient material would be ablated from the interior of the housing by arcing to expose the fiberglass or other strengthening material. This exposed material both does not have arc-extinguishing properties and, due to the creation of internal surface irregularities within the tube, could degrade or interfere with the arc-extinguishing action such a fuse tube should exhibit.

SUMMARY OF THE INVENTION

In accordance with the present invention, there is provided an improved fuse tube which is usable in a fuse. In general, the fuse tube has a bore in which a fusible element is locatable. The bore walls include an arc-extinguishing material.

The improved fuse tube includes an inner-bore-defining fuse tube portion which is molded from a thermosetting material and includes an effective amount of an arc-extinguishing medium therein. An outer, weather-resistant, fuse tube portion is molded simultaneously with and from the same material as the inner portion. The inner and outer portions merge together to constitute an integral continuum of the thermosetting material. A layer of porous or intersticial reinforcement material is incorporated within the outer portion remote from the bore. The reinforcement material is incorporated between the portions during the simultaneous molding of both portions. The reinforcement material is sufficiently porous to permit both the passage therethrough of the thermosetting material of both portions during molding and thorough impregnation thereof from both sides with the thermosetting material to lock the portions thereto and to each other, thus forming a mechanically strong, integral fuse tube.

Thus, the improved fuse tube is made of a single molded material rather than two separate materials. The reinforcement material is incorporated at or near the boundary of the tube portions so that it is sufficiently far from the bore to not interfere with the arc-extinguishing action thereof. Additionally, the inclusion of the reinforcing material lends added mechanical strength to the fuse tube to resist both rough handling thereof and bursting thereof during operation of a fuse or fuse cutout in which the fuse tube may be included.

In preferred embodiments, the thermosetting material of both the inner and outer portions of the fuse tube is a cycloaliphatic epoxy resin which is molded by pressure gelation. Also in preferred embodiments, the reinforcement material is a fiberglass cloth or mat or spirally wound fiberglass strands. The inclusion of the reinforcing material more than compensates for the slight mechanical weakening imparted to the thermosetting material by the inclusion therein of an arc-extinguishing medium.

BRIEF DESCRIPTION OF THE DRAWING

The FIGURE illustrates a fuse tube according to the present invention.

DETAILED DESCRIPTION

Figure 1:
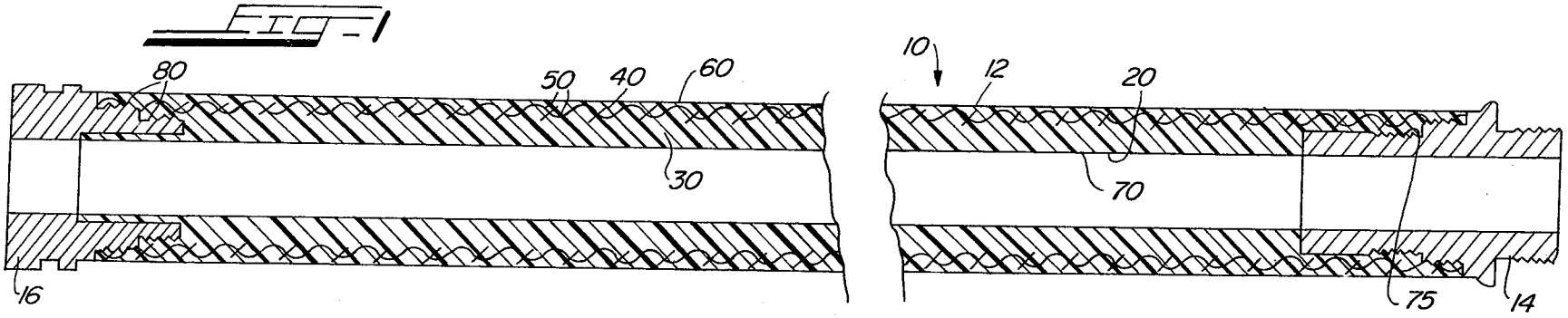
Figure 2:
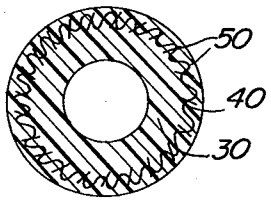

Referring to the FIGURE, there is shown a fuse tube 10 in accordance with the present invention. The fuse tube is usable in a fuse or fuse cutout (not shown) which may be of the type disclosed in commonly-assigned, co-pending United States Patent Applications, Ser. No. 188,636, filed Sept. 19, 1980 and Ser. No. 132,922; 132,923; and 132,924, all filed Mar. 24, 1980.

As depicted in the FIGURE, the fuse tube 10 includes a main body 12 with an upper ferrule 14 and a lower ferrule 16 integrally attached thereto. The main body 12 contains an interior, elongated bore 20. In use, appropriate end fittings (not shown) are connected to the ferrules 14 and 16 and the fuse tube 10 is "armed" by including within the bore 20 a fuse link (not shown) having a fusible element mounted between a stationary and a movable contact. The stationary contact is in continuous electrical contact with the upper ferrule 14, while the movable contact via a flexible cable (not shown) is in continuous electrical contact with the lower ferrule 16. The fuse tube and the end fittings are placed in a mounting (not shown), and current in a circuit to which the fusible element is electrically connected normally passes therethrough. Should an overcurrent in the circuit occur, the fusible element melts or fuses, and, as the cable exits the bore 20 through the lower ferrule 16, the contacts separate. This action causes elongation of an arc established between the contacts within the bore 20. The arc interacts with the material of the bore 20 to evolve large quantities of cooling, de-ionizing and turbulent gas. Arc elongation and the action of the gas ultimately extinguish the arc.

In accordance with the present invention, the body 12 of the fuse tube 10 includes an inner portion 30 and an outer portion 40. Both portions 30 and 40 are made of the same insulative material, preferably a cycloaliphatic epoxy resin formed by a molding technique known as pressure gelation. The boundary between the two portions 30 and 40 of the body 12 is defined by a cylinder 50 of a rinforcing material, such as woven fiberglass cloth or mat or spirally wound fiberglass strands.

The body 12 and, specifically, the portions 30 and 40, contain an amount of arc-extinguishing material effective to ensure extinguishment of any arc formed in the bore 20 during operation of a cutout in which the fuse tube 10 is utilized. Any suitable arc-extinguishing material may be utilized, preferred arc-extinguishing materials being melamine, dicyandiamide (as disclosed is commonly-assigned, co-pending United States Patent Application, Ser. No. 708,548, filed July 26, 1976) or hexamethylenetetramine (as disclosed in commonly-assigned United States Patent Application, Ser. No. 671,319, filed Mar. 29, 1976). The arc-extinguishing material may be incorporated into the epoxy resing in particulate form.

In making the fuse tube 10, the cylinder 50 may be initially formed on a mandrel (not shown). Subsequently, the cylinder 50 is placed in a mold where the portion 30 is molded thereagainst from the inside and the portion 40 is molded thereagainst from the outside. The cylinder 50 must be sufficiently porous or have a sufficiently large mesh so that the material constituting both portions 30 and 40 may pass in both directions therethrough and so that the portions 30 and 40 bond to each other and to the cylinder 50 to ultimately form an integral continuum of thermosetting material. Thus, not only do the portions 30 and 40 form a continuum, but the cylinder 50 is fixed within the body 12 to provide sufficient mechanical strength to the fuse tube 10 to resist both rough handling and pressure increases within the bore 20 during operation of the fuse or fuse cutout in which the fuse tube 10 is contained. Furthermore, the cylinder 50 is substantially closer to an outside wall 60 forming an external surface of the portion 40 than it is to an inside wall 70 of the bore 20. The reason for this placement of the cylinder 50 is that, as the wall 70 of the bore 20 erodes during continued usage of the fuse tube 10, the fiberglass of the cylinder 50 is not exposed within the bore 20 to interfere with the arc-extinguishing action thereof.

Preferably, the end ferrules 14 and 16 are integrally attached to the body portion 12 during the molding thereof. Specifically, in preferred forms, the fiberglass tube 50 is positioned over external portions of the ferrules 14 and 16, which may contain surface iregularities or knurling 75 and 80 thereon, and then the portions 30 and 40 may be molded so as to engage the ferrules 14 and 16. As a consequence of the pressure gelation of the portions 30 and 40, the fiberglass tube 50 is locked in place within the body 12, the portions 30 and 40 are locked to each other, and the end ferrules 14 and 16 are locked in position at the ends of the fuse tube 10.

The above-described structure differs from that shown in the George, Healey, Blewitt, Harmon, and Kozacka patents in that the fiberglass tube 50 is positioned substantially away from the internal bore 20 and closer to the exterior surface 60 of the portion 40. As noted previously, all of these patents disclose housings particularly useful with current-limiting fuses in which an internal bore of the housing is expected to play no role in arc-extinguishing and, accordingly, in which concerns about the ultimate exposure of fiberglass and reinforcement within the bore are irrelevant. Similarly, commonly-assigned, co-pending Patent Application, Ser. No. 73,667, noted earlier, discloses a polymeric fuse tube containing fiberglass reinforcement. Again, however, the fuse tube of this co-pending patent application is intended for use in a current-limiting or similar fuse in which an internal bore of the housing plays little, if any, role in arc-extinguishment and in which the fiberglass reinforcement is positioned substantially at the interior surface of the internal bore.

Moreover, the structure of the present invention constitutes an improvement over structure shown in the Russell, Stewart and White patents wherein fiberglass reinforcement is used to provide mechanical strength to an outer portion of a fuse tube, but wherein an inner sleeve, separate from the outer portion and made of a material different from the outer portion, is provided to ensure that arc-extingusihing action can take place within the fuse tube. In the present structure, the portions 30 and 40 of the fuse tube 10 are both formed of the same material and are locked together due to their ability to pass through the meshes or pores of the fiberglass reinforcement tube 50 to form the above-described continuum.

The body 12 of the fuse tube 10 is rendered weather resistant due to the normal curing and finishing of the exterior surface 60 during the pressure gelation of the material constituting the body 12. It has been found that pressure gelation of cycloaliphatic epoxy resins provides an exterior surface 60 which exhibits low tracking and which is capable of resisting the degrading effects of the environment, including the effects of rain, wind, moisture, and sunlight. The fact that the portions 30 and 40 merge through the cylinder 50 and are locked together as a continuum eliminates any possibility that these portions 30 and 40 will delaminate or separate due to thermal cycling.

I claim:

1. An improved fuse tube for a fuse, the fuse tube having a bore in which a fusible element is locatable, the bore walls including an arc-extinguishing medium, wherein the improvement comprises:

an inner, bore-defining fuse tube portion molded from a thermosetting material having an effective amount of an arc-extinguishing material therein;

an outer, weather-resistant fuse tube portion molded simultaneously with and from the same materials as the inner portion, the inner and outer portions being merged together and forming an integral continuum of the thermosetting material; and a layer of porous reinforcement material incorporated between the portions during the simultaneous molding of both portions, the reinforcement material being sufficently porous to permit both (a) passage therethrough of the thermosetting material of both portions during molding and (b) thorough impregnation thereof from both sides with the thermosetting material to lock both portions thereto and to each other and to form a mechanically strong fuse tube, the porous reinforcement material layer being sufficiently remote from the bore so that errosion of the bore due to usage of the fuse tube does not expose the reinforcement material at the interior surface of the bore.

2. A fuse tube as in claim 1, which further comprises at least one metallic ferrule integrally held to an end of the fuse tube in contact with the inner surface of the reinforcement layer by molding about a segment thereof the inner and outer portions.

3. A fuse tube as in claim 1, wherein, the thermosetting material is a cycloaliphatic epoxy resin which is molded by pressure gelation.

4. A fuse tube as in claim 1, wherein, the arc-extinguishing medium includes a particulate material selected from the group consisting of melamine, dicyandiamide and hexamethylenetetramine.

5. A fuse tube as in claim 4, wherein, the thermosetting material is a cycloaliphatic epoxy resin.

6. A fuse tube as in claim 1, wherein the layer of reinforcement material is located substantially farther from the bore defined by the inner fuse portion than it is from the outer surface of the outer fuse tube portion.

7. A fuse tube as in claim 6, wherein the porous reinforcement material is a cylinder of fiberglass cloth or mat or is wound fiberglass filament.

* * * * *